US008893507B2

(12) United States Patent
Rajesh et al.

(10) Patent No.: US 8,893,507 B2
(45) Date of Patent: Nov. 25, 2014

(54) METHOD FOR CONTROLLING GAS TURBINE ROTOR TEMPERATURE DURING PERIODS OF EXTENDED DOWNTIME

(75) Inventors: Prabhakaran Saraswathi Rajesh, Bangalore (IN); Rajarshi Saha, Bangalore (IN); Durgaprasad Janapaneedi, Bangalore (IN); Satyanarayana Venkata Ravindra Emani, Bangalore (IN)

(73) Assignee: General Electric Company, Schenectady, NY (US)

( * ) Notice: Subject to any disclaimer, the term of this patent is extended or adjusted under 35 U.S.C. 154(b) by 572 days.

(21) Appl. No.: 13/289,080

(22) Filed: Nov. 4, 2011

(65) Prior Publication Data

US 2013/0111921 A1 May 9, 2013

(51) Int. Cl.

| | |
|---|---|
| ***F02G 3/00*** | (2006.01) |
| ***F02C 6/08*** | (2006.01) |
| ***F01K 13/02*** | (2006.01) |
| ***F01D 5/08*** | (2006.01) |
| ***F01D 25/10*** | (2006.01) |

(52) U.S. Cl.

CPC . *F01D 5/08* (2013.01); *F01D 25/10* (2013.01)
USPC ..... 60/782; 60/39.091; 60/646; 60/656

(58) Field of Classification Search

CPC ..... F01K 13/02; F01K 3/22; F01D 19/00; F22B 35/14
USPC ..... 60/782, 785, 656, 646, 39.091, 778; 415/1, 114, 115, 116, 117, 117.1; 416/96 A, 97 R, 198 A, 200 A, 201 R
See application file for complete search history.

(56) References Cited

U.S. PATENT DOCUMENTS

| | | | | |
|---|---|---|---|---|
| 2,603,453 | A | 7/1952 | Sollinger | |
| 2,617,253 | A * | 11/1952 | Fusner et al. | 60/39.091 |
| 2,915,279 | A | 12/1959 | Chamberlin | |
| 4,726,735 | A | 2/1988 | Field et al. | |
| 4,880,354 | A * | 11/1989 | Teranishi et al. | 416/95 |
| 4,967,552 | A * | 11/1990 | Kumata et al. | 60/806 |
| 5,020,970 | A | 6/1991 | Dussourd et al. | |
| 5,054,996 | A * | 10/1991 | Carreno | 415/115 |
| 5,281,097 | A | 1/1994 | Wilson et al. | |
| 5,473,898 | A * | 12/1995 | Briesch | 60/646 |
| 5,498,131 | A * | 3/1996 | Minto | 415/216.1 |
| 6,273,683 | B1 | 8/2001 | Zagar et al. | |
| 6,428,270 | B1 | 8/2002 | Leone et al. | |
| 6,431,833 | B2 | 8/2002 | Jones | |
| 6,478,540 | B2 | 11/2002 | Abuaf et al. | |
| 7,189,063 | B2 | 3/2007 | Honkomp | |
| 2003/0046939 | A1 * | 3/2003 | Hyakutake et al. | 60/782 |

(Continued)

*Primary Examiner* — Gerald L Sung
(74) *Attorney, Agent, or Firm* — Nixon & Vanderhye P.C.

(57) ABSTRACT

A method for warming the rotor of a gas turbine during extended periods of downtime comprising feeding ambient air to an air blower; extracting compressed air from the air blower; feeding a portion of the compressed air to one side of a heat exchanger and steam (typically saturated) from e.g. a gas turbine heat recovery steam generator; passing the resulting heated air stream from the exchanger into and through into defined flow channels formed within the rotor; continuously monitoring the air temperature inside the rotor; and controlling the amount of air and steam fed to the heat exchanger using a feedback control loop that controls the amount of air and steam feeds to the exchanger and/or adjusts the flow rate of heated air stream into the rotor.

15 Claims, 5 Drawing Sheets

(56) References Cited

U.S. PATENT DOCUMENTS

2004/0045300 A1* 3/2004 Dovali-Solis ..... 60/778
2009/0193787 A1* 8/2009 West et al. ..... 60/39.182
2010/0247304 A1 9/2010 Merchant et al.

* cited by examiner

TABLE 1

| Name | Type | Outer Diameter (inch) | Wall thickness (inch) | Transverse Pitch (inch) | Longitudinal pitch (inch) | Fin Height (inch) |
|---|---|---|---|---|---|---|
| TubeType | Plain | 1.0000 | 0.0650 | 1.2500 | 1.0825 | n/a |

| Row | Number of Tubes | Tube Type | Wall Clearance (inch) |
|---|---|---|---|
| 1 | 4 | TubeType 1 | 0.3750 |
| 2 | 3 | TubeType 1 | 1.0000 |
| 3 | 4 | TubeType 1 | 0.3750 |

| Fluid | Temperature (°F) | |
|---|---|---|
| | Out | In |
| Steam | 417(Q=1) | 417 (Q=0.6) |
| Air | -25 | 7 |

Bundle Information

| | |
|---|---|
| Bundle width | 0.458 ft |
| Number of tube rows | 3 |
| Number of Tubes | 11 |
| Minimum wall clearance | |
| Left | 0.375 inch |
| Right | 0.375 inch |
| Number of tubes per pass | |
| O Tubepass # 1: | 11 |

| | |
|---|---|
| Air Flow: | 1125 SCFM |
| Steam flow required: | ~ 150 lb/hr |
| Heat Exchanger Area: | ~ 3 ft2 |
| Material: | SS, 304 |

FIG. 5

METHOD FOR CONTROLLING GAS TURBINE ROTOR TEMPERATURE DURING PERIODS OF EXTENDED DOWNTIME

BACKGROUND OF THE INVENTION

The present invention relates to a method and apparatus for warming a gas turbine engine rotor and, in particular, to a method for controlling the gas turbine rotor temperature during periods of extended downtime using steam to heat air extracted from a gas turbine enclosure which is then fed directly to the rotor. In an alternative embodiment, the method utilizes auxiliary boiler steam for purposes of heating the air fed to selected rotor passages during extended periods of downtime.

Gas turbine engines typically include a compressor section, a combustor section and at least one turbine that rotates in order to generate electrical power. The compressor discharge feeds directly into the combustor section where hydrocarbon fuel is injected, mixed and burned. The combustion gases are then channeled into and through one or more stages of the turbine which extracts rotational energy from the combustion gases. The temperature of gas turbine rotor blades rises very quickly when a gas turbine is started because the blades are exposed to very high-temperature exhaust gases. The temperature of the outer peripheral parts of a turbine also increase very quickly due to heat conduction from the blade as compared to inner peripheral rotor components. The rate of increase in temperature thus tends to be slower on the inner side of the rotor than on the outer side. The difference in conductivity of components can also cause a temperature differential between the inner and outer peripheries of rotor components, creating additional thermal stresses during startup. A separate centrifugal stress also exists during startup due to rotation of the engine.

Thus, the combination of thermal and centrifugal stresses on the rotor are much higher when the engine has been sitting idle during, for example, periodic maintenance. As a result, during startup following extended periods of downtime, the rotor disks can undergo significant thermal and mechanical stresses and are vulnerable to premature failure due to the shock occurring during startup, particularly at or near the rotor disks.

An example of a conventional rotor warming structure for a combined cycle plant includes a central gas flow passage with gas from a compressor fed into the central passage in the rotor. Normally, a portion of the compressed gas is introduced into the gas turbine blades through branches emanating from a central passage. Another known method for warming the rotor prior to startup relies on an electrical heating system surrounding the rotor. However, such systems can be prohibitively expensive and often do not sufficiently protect against temperature differentials during startup. Both air and electrical systems also do not take advantage of the potential heating and cost-saving benefits using on-site steam available within the same power generating plant.

BRIEF DESCRIPTION OF THE INVENTION

A primary object of the present invention is to provide a method and apparatus for keeping a gas turbine rotor warm during periods of extended downtime by using a portion of the flow from a steam turbine or, alternatively, from an outside steam source, in order to heat air originating from the gas turbine enclosure. The higher temperature air in turn serves as a more effective primary heat source for the rotor cavity and blades.

As detailed below, a new method for warming the rotor of a gas turbine engine comprises the steps of feeding an ambient air stream to an air blower to increase the air pressure; extracting a portion of compressed air from the discharge of the air blower while feeding a partial air stream to one side of a heat exchanger (e.g., shell and tube type); feeding steam (typically saturated) to the other side of the same heat exchanger; passing the resulting heated air stream from the heat exchanger into and through defined flow channels inside the rotor; continuously monitoring the air temperature inside the rotor during the warming operation; and controlling the amount of air and steam fed to the heat exchanger based on the temperature detected inside the rotor using a feedback control loop. The feedback control data can also be used to monitor and adjust the flow rate into the rotor of a heated air stream.

The invention also includes a related structure for warming a gas turbine rotor during periods of downtime comprising an air blower, a heat exchanger for heating compressed air from the air blower using heat from an internal steam source, a plurality of air passages into and out of the rotor sufficient in size and number to carry a prescribed amount of heated air through the rotor to heat the turbine blades and rotor cavities to a uniform temperature, steam fluid flow passages into and out of the heat exchanger, and a feedback control loop for controlling the amount of air and steam fed to the heat exchanger.

BRIEF DESCRIPTION OF THE DRAWINGS

FIG. 5 shows Table 1.

DETAILED DESCRIPTION OF THE INVENTION

The warming structure described herein is particularly useful in cold weather conditions and specifically intended to replace conventional electric heaters used to warm a gas turbine rotor during extended periods of downtime. In an exemplary embodiment, steam from another part of the plant is used as the principal heating medium and results in a more cost effective and reliable heating system without using conventional electric heaters. A portion of sealing flow from the steam turbine or gland leakage steam transfers heat to an inlet air feed using a combination heat exchanger and air blower. An alternative embodiment uses a similar configuration but with auxiliary boiler steam as the primary source of heat.

The invention offers particular advantages to multi gas turbine plant configurations where saturated steam is readily available for warming up one or more gas turbine rotors during periods of downtime. As the principal heating source, the steam can be extracted from auxiliary boiler/gland steam/sealing sources. A shell and tube heat exchanger transfers heat from the steam to air taken from a gas turbine enclosure that has been compressed using a blower. The heated air is then fed to the gas turbine inlet plenum through a control valve and piping network and the spent steam is fed back into the gas turbine engine bottoming cycle. As such, the invention provides a much more cost effective method for keeping the gas turbine rotor warm while the system is out of service.

Figure 1:
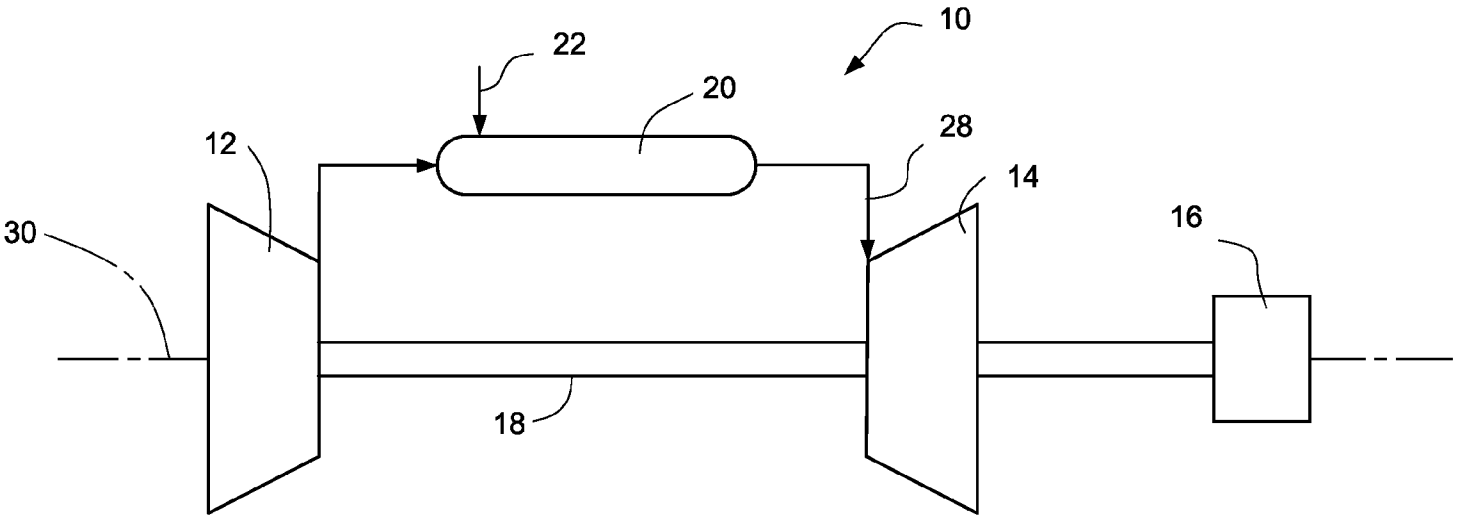
FIG. 1 is a schematic diagram of an exemplary gas turbine engine adapted to incorporate the steam-based heat exchange system for a rotor during extended periods of downtime.

Turning to the figures, FIG. 1 is a schematic diagram of an exemplary gas turbine engine adapted to incorporate the steam-based heat exchange system for a rotor during periods of downtime. Gas turbine engine 10 is coupled to an electric generator 16 and includes a compressor 12, a turbine 14 and generator 16 arranged with a single monolithic shaft 18. Compressor 12 supplies compressed air to combustor 20 where the air is mixed with fuel supplied via fuel stream 22. In operation, air flows through compressor 12 and compressed air is supplied combustor 20. Combustion gases 28 from combustor 20 propel turbine 14 which in turn rotates shaft 18, compressor 12 and electric generator 16 about longitudinal axis 30. Low pressure turbine 20 rotates first shaft 26 and low pressure compressor 12 about the longitudinal axis.

Figure 2:
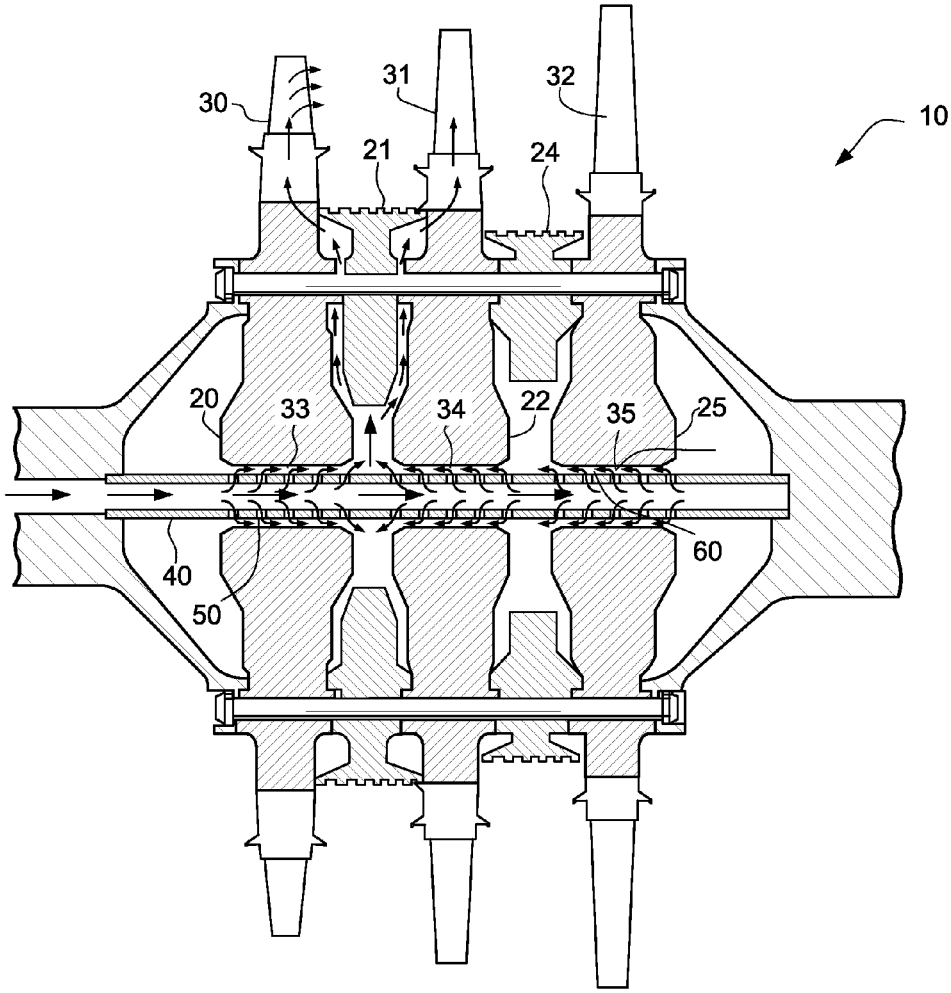
FIG. 2 is a sectional view of a gas turbine rotor depicting a nominal flow profile for use with the steam-based heat exchange system according to the invention.

FIG. 2 is a sectional view of a gas turbine rotor depicting a nominal flow profile for use with the steam-based heat exchange system of the present invention. See, e.g., expired U.S. Pat. No. 4,880,354. Normally, the rotor includes a plurality of circumferentially-spaced rotor blades coupled to the turbine rotor, where each rotor blade includes a shank, a platform having an upper and lower surface coupled to the shank and a first component coupled to the platform lower surface and the shank. A substantially hollow plenum is defined between the first component, the shank, and the platform lower surface. An airfoil is also coupled to the platform.

A typical gas turbine rotor such as that shown in FIG. 2 and identified at 10 includes a first stage disk 20, a spacer 21 between first and second stages, a second stage disk 22, spacer 24 between second and third stages, a third stage disk 25 and front and rear side shafts 26 and 27 joined together as shown. A first stage blade 30, a second stage blade 31 and third stage blade 32 are fitted to the outer peripheries of the respective disks. Once installed, the disks define a series of central fluid passages 33, 34, 35, respectively, sufficient in size to accommodate air flow through tubular member 40 which is common to all disks and extending between the disks to define a common fluid flow channel. Tubular member 40 includes a plurality of smaller fluid passageways 50 opened at positions facing the respective inner walls of the central opening for the disks as shown.

Heated air from the heat exchanger system generally described above and in more detail in FIG. 3 passes through the plurality of small fluid passages and against the inner walls on the sides of each disk. The effect of blowing hot air in this manner allows the disks to be warmed uniformly without significant temperature gradients during a cold startup of the gas turbine engine. After the compressed and heated air from the heat exchanger is blown against the inner wall of the central openings in the disks, the air passes through a channel formed between the tubular member 40 and the inner walls of the central openings in the manner illustrated into the space between the first and second stage disks.

Figure 3:
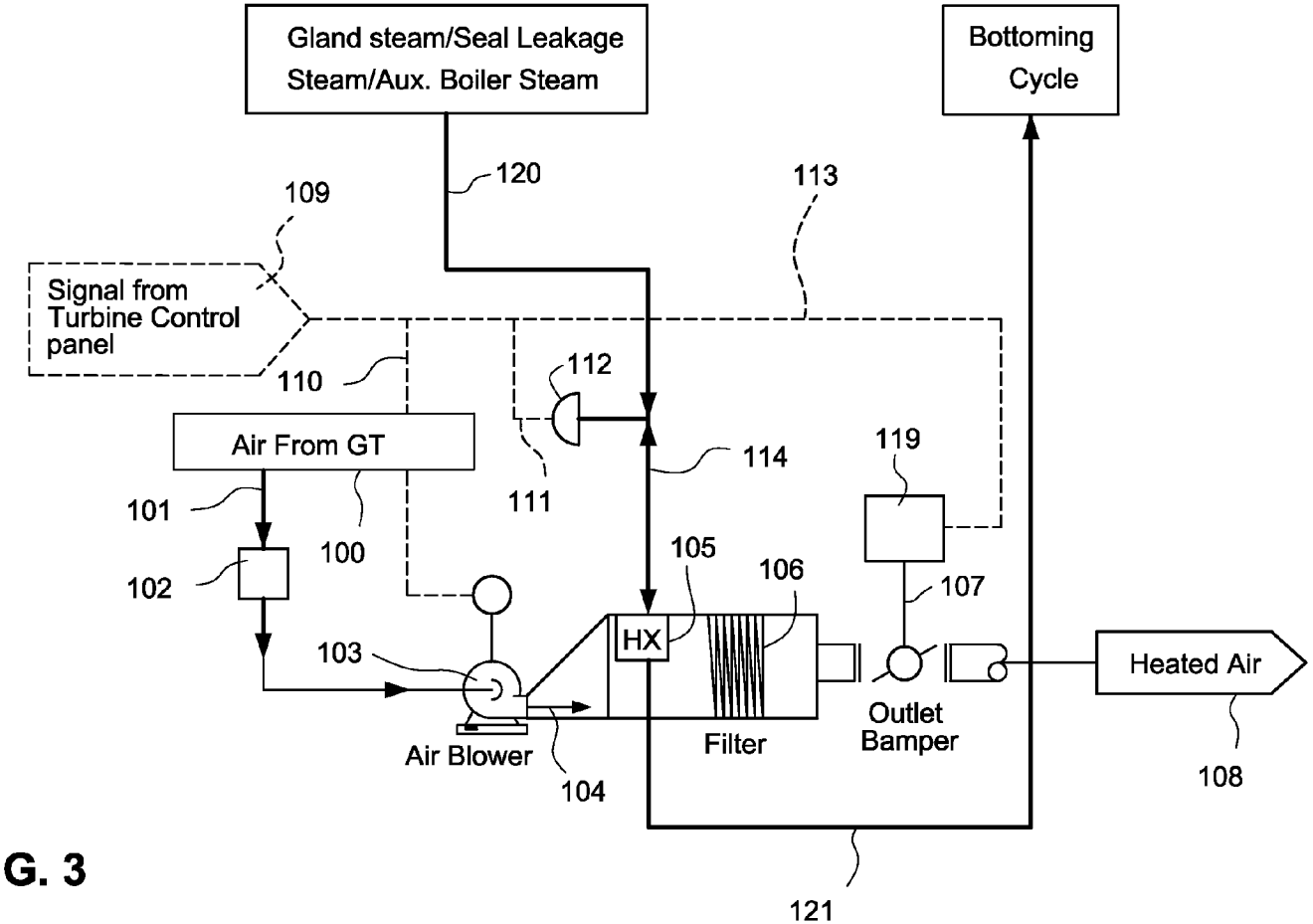
FIG. 3 is a process flow diagram illustrating the flow configuration of an exemplary heat exchange system according to the invention.

FIG. 3 is a process flow diagram depicting an exemplary flow configuration for heat exchange systems effective in warming a rotor during extended periods of downtime. An air feed at ambient temperature passes through inlet air line 101 through air filter 102 into air blower 103 where the increase in pressure results in an air flow sufficient to ensure a constant flow of heated air using heat exchanger 105 as the feed to the rotor. Compressed air stream 104 from air blower passes into and through the heat exchanger using saturated steam as the heating medium (see the exemplary heat exchanger design details in Table 1 below). The resulting heated air stream passes through air filter 106 and exits as shown through outlet damper 107 as the primary air feed to the rotor as described above in connection with FIG. 2. The gland leakage steam, sealing steam and/or boiler steam passes through heat exchanger 105 through steam inlet line 120, with the spent steam exhaust 113 being returned to the gas turbine bottoming cycle 121.

In order to ensure that warming of the gas turbine engine rotor occurs at a prescribed rate without creating potential damage to the rotor disks, FIG. 3 also shows the use of a feedback control loop which includes an initial temperature control signal 109 from the gas turbine engine control panel used to control the amount of steam being fed to heat exchanger 105 via control valve 112, along with input signal line 107, feedback control line 111 and heat exchanger steam feed 114. Feedback control loop 113 also includes means for controlling damper 107 downstream of heat exchanger 105 and thus operates to control the amount of the heated air stream 108 being fed to the gas turbine rotor.

Figure 4:
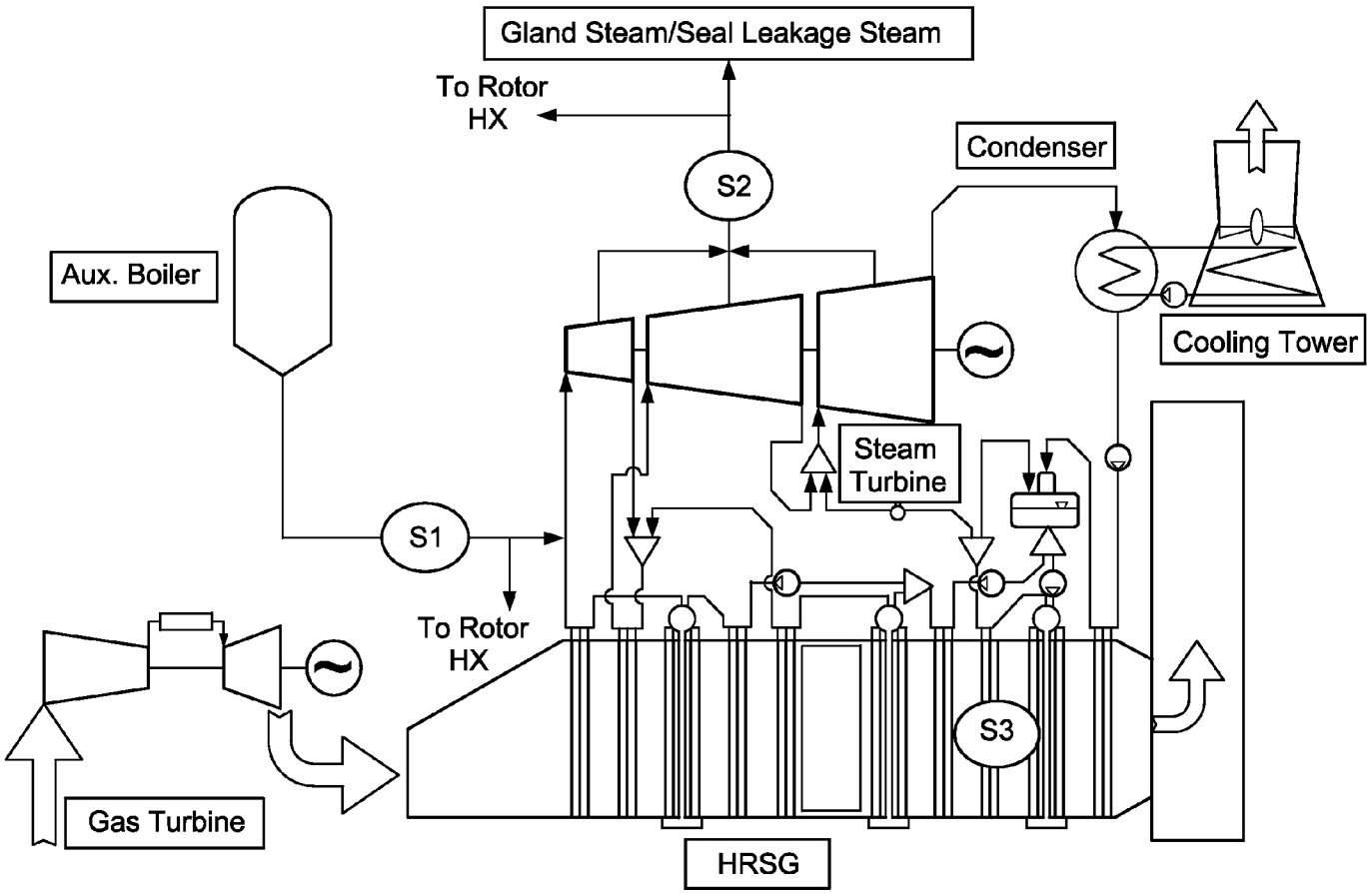
FIG. 4 is a process flow diagram depicting the major pieces of process equipment for a gas turbine engine, HRSG and steam turbine for purposes of illustrating candidate sources of steam during periods of downtime for a steam-based heat exchange system according to the invention.

FIG. 4 is a process flow diagram depicting the major pieces of process equipment for a gas turbine engine, HRSG and steam turbine for purposes of illustrating candidate sources of steam during periods of downtime for a steam-based heat exchange system according to the invention. As noted above, one side of an exemplary heat exchanger as used to provide controlled heat to the rotor during periods of downtime relies upon steam obtained from one of three different sources as shown in FIG. 4, namely from an auxiliary boiler (taken from boiler feed line S1), or from the available gland steam and seal leakage steam lines (S2) or from the heat recovery steam generator (S3). As FIGS. 2 and 3 illustrate, one or more candidate steam feeds will be used as the primary heating medium for the rotor on one side of the heat exchanger, with a controlled air feed on the other side. As also noted above, the resulting heated air at a defined elevated temperature feeds into and through the rotor during periods of downtime. The spent steam from the heat exchanger is then returned to the bottoming cycle.

An exemplary heat exchanger design useful in achieving the objectives of the invention is summarized below in Table 1. The shell and tube heat exchanger for the rotor uses one of two alternative streams, namely a portion of the sealing flow from a steam turbine or, in the alternative, a portion of auxiliary boiler steam form an outside source. In the example of Table 1, the amount of air to be heated on the tube side and corresponding steam flow requirements are identified for an exchanger having the specific tube sizes, dimensions and pitch configuration as shown. Table 1 also includes exemplary tube bundle design criteria, as well as inlet and outlet design temperatures for the air and steam as they enter and exit the exchanger. The resulting heated air is used in connection with the control system as described above in order to bring the rotor disks to the desired minimum temperature and thereafter maintain the same internal temperature during startup of the engine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for warming the rotor of a gas turbine during periods of downtime, comprising:

feeding a stream of ambient air to an air blower;

increasing the pressure of said ambient air stream;

extracting a portion of compressed air from the discharge of said air blower;

feeding said portion of compressed air to one side of a heat exchanger;

feeding steam to the other side of said heat exchanger;

passing a resulting heated air stream from said heat exchanger into and through said rotor;

monitoring the air temperature inside said rotor; and controlling the amount of air and steam fed to said heat exchanger based on said monitored air temperature.

2. A method according to claim 1, further comprising the step of providing a plurality of air flow passages inside said rotor.

3. A method according to claim 2, wherein said air flow passages are sufficient in size and number to allow for a continuous flow of said heated air stream to the inner walls and disks of said rotor.

4. A method according to claim 1, wherein said step of feeding steam to said heat exchanger further includes the step of extracting said steam from an auxiliary boiler.

5. A method according to claim 1, wherein said step of feeding steam to said heat exchanger further includes the step of extracting saturated steam from a heat recovery steam generator as feed to said heat exchanger.

6. A method according to claim 1, further including the step of passing said heated air stream through an air filter upstream of said rotor.

7. A method according to claim 1, further including the step of returning spent steam from said heat exchanger to a bottoming cycle of said gas turbine.

8. A method according to claim 1, wherein said step of controlling the amount of air and steam fed to said heat exchanger is based on data provided by a feedback control loop.

9. A method according to claim 8, wherein said data provided by said feedback control loop includes the temperature inside said rotor and the amount of heated air passing into and through said rotor.

10. A method according to claim 1, wherein said step of feeding steam to said heat exchanger uses a portion of a gland steam from said gas turbine.

11. A structure for warming a gas turbine rotor during periods of downtime, comprising:

an air blower;

a heat exchanger for heating compressed air from said air blower, said heat exchanger transferring heat to said compressed air derived from an outside steam source;

air passages into and out of said rotor sufficient in size to carry a prescribed amount of heated air through said rotor to heat the turbine blades in said rotor;

steam fluid flow passages into and out of said heat exchanger and a feedback control loop for controlling the amount of air and steam fed to said heat exchanger.

12. A structure according to claim 11, further including an air filter for said heated air.

13. A structure according to claim 11, wherein said feedback control loop includes temperature sensors for monitoring the air temperature inside said rotor.

14. A structure according to claim 11, wherein said feedback control loop includes signal generators for transmitting data relating to the amount of said heated air being fed to said rotor.

15. A structure according to claim 11, further including an air damper for controlling the amount of air fed to said heat exchanger.

* * * * *